United States Patent [19]

Miller

[11] Patent Number: 4,795,081

[45] Date of Patent: Jan. 3, 1989

[54] ONE-PIECE PAPERBOARD CARTON AND TELESCOPING CLOSURE MEMBER

[75] Inventor: Richard N. Miller, Evansville, Ind.

[73] Assignee: Keller-Crescent Co., Inc., Evansville, Ind.

[21] Appl. No.: 103,112

[22] Filed: Sep. 30, 1987

[51] Int. Cl.[4] ..... B65D 5/36

[52] U.S. Cl. ..... 229/19; 220/416; 229/9; 229/23 BT; 229/41 B; 229/129; 493/59; 493/99; 493/906

[58] Field of Search ..... 229/41 R, 41 B, 9, 11, 229/19, 20, 23 BT, 129, 41 C, 41 D; 220/416; 221/305; 493/59, 99, 121, 162, 906

[56] References Cited

U.S. PATENT DOCUMENTS

| | | | |
|---|---|---|---|
| 2,410,923 | 11/1946 | Beardsley | 229/11 |
| 3,371,844 | 3/1968 | Perrella | 229/129 |
| 3,416,718 | 12/1968 | Nakayana | 229/129 |
| 3,556,385 | 1/1971 | Kato | 229/8 |
| 3,780,932 | 12/1973 | McLaren et al. | 229/129 |

*Primary Examiner*—Stephen Marcus

*Assistant Examiner*—Gary E. Elkins

*Attorney, Agent, or Firm*—Woodard, Emhardt, Naughton Moriarty & McNett

[57] ABSTRACT

A one-piece paperboard container and closure member telescopically opens and closes and, in the process of opening, reveals hidden matter printed on the container body portion, the closure member automatically frictionally locking onto the container body portion in the closed position. A single paperboard blank has a first and second set of four serially connected rectangular panels, a corresponding set of connecting strips connecting the first and second set of panels and cooperating therewith to provide a top for the closure member and to provide telescopic movement of the closure member relative to the container body portion, a series of proportionately sized V-cuts between each of the first set of panels, just below and adjacent to the strips, and two pairs of converging cut score lines and a central perforated score line at non-adjacent corners of the constructed container body portion, the converging cut score lines having a predetermined height less than the height of the closure member.

19 Claims, 2 Drawing Sheets

ONE-PIECE PAPERBOARD CARTON AND TELESCOPING CLOSURE MEMBER

FIELD OF THE INVENTION

The present invention relates to the field of paperboard cartons and more particularly to a paperboard carton and telescoping closure member formed from a single blank.

BACKGROUND OF THE INVENTION

Marketing strategists spend a great deal of time designing the appearance of the packaging for a particular product. They are generally limited only by the surface area which is readily visible to the consumer's eye. Other than the obvious exterior surface area of a conventional paperboard or cardboard carton, it is also known to provide printed matter concerning the product on the underside of the conventional closure flaps of the carton so that when the consumer lifts the flaps to access the carton's interior, the printed matter on the underside of the flaps will become visible to the consumer. This additional space on the underside of the flaps usually does not provide a great amount of additional marketing or advertising space and is sometimes overlooked by the consumer. Additional printed matter may be provided on special tear-away flaps or on brochures inserted right in the carton. Such methods are often expensive or are often overlooked by the consumer. What is needed is a packaging device which provides a substantial amount of additional surface area for product information and advertising and which does so in such a way as to capture the attention and interest of the consumer.

SUMMARY OF THE INVENTION

Generally speaking, there is provided a one-piece paperboard container with closure member which telescopically opens and closes the container body portion and, in the process of opening, reveals hidden matter printed on the container body portion. The closure member automatically frictionally locks onto the container body portion in the closed position.

The container and closure member is constructed from a single, cut and scored, paperboard blank having a first and second set of four serially connected rectangular panels for forming the container body portion and closure member, respectively. A corresponding set of connecting strips connect the first and second set of panels and cooperate therewith to provide a top for the closure member and to provide telescopic movement of the closure member relative to the container body portion. A series of proportionately sized V-cuts are provided at the top of and between each of the first set of panels, just below and adjacent to the strips. Two pairs of converging cut score lines and a central perforated score line are provided at non-adjacent corners of the constructed container body portion, the converging cut score lines having a predetermined height less than the height of the closure member.

It is an object of the present invention to provide a single blank for forming an improved one-piece paperboard container with body portion and telescoping closure member.

It is another object of the present invention to provide a paperboard container with telescopically openable and closable closure member which frictionally locks in the closed position.

It is yet another object of the present invention to provide a paperboard container with telescopic closure member which, in the process of opening, reveals hidden matter printed on the exterior of the container body portion.

Further objects and advantages of the present invention will become apparent from the following description.

DESCRIPTION OF THE PREFERRED EMBODIMENT

Figure 1:
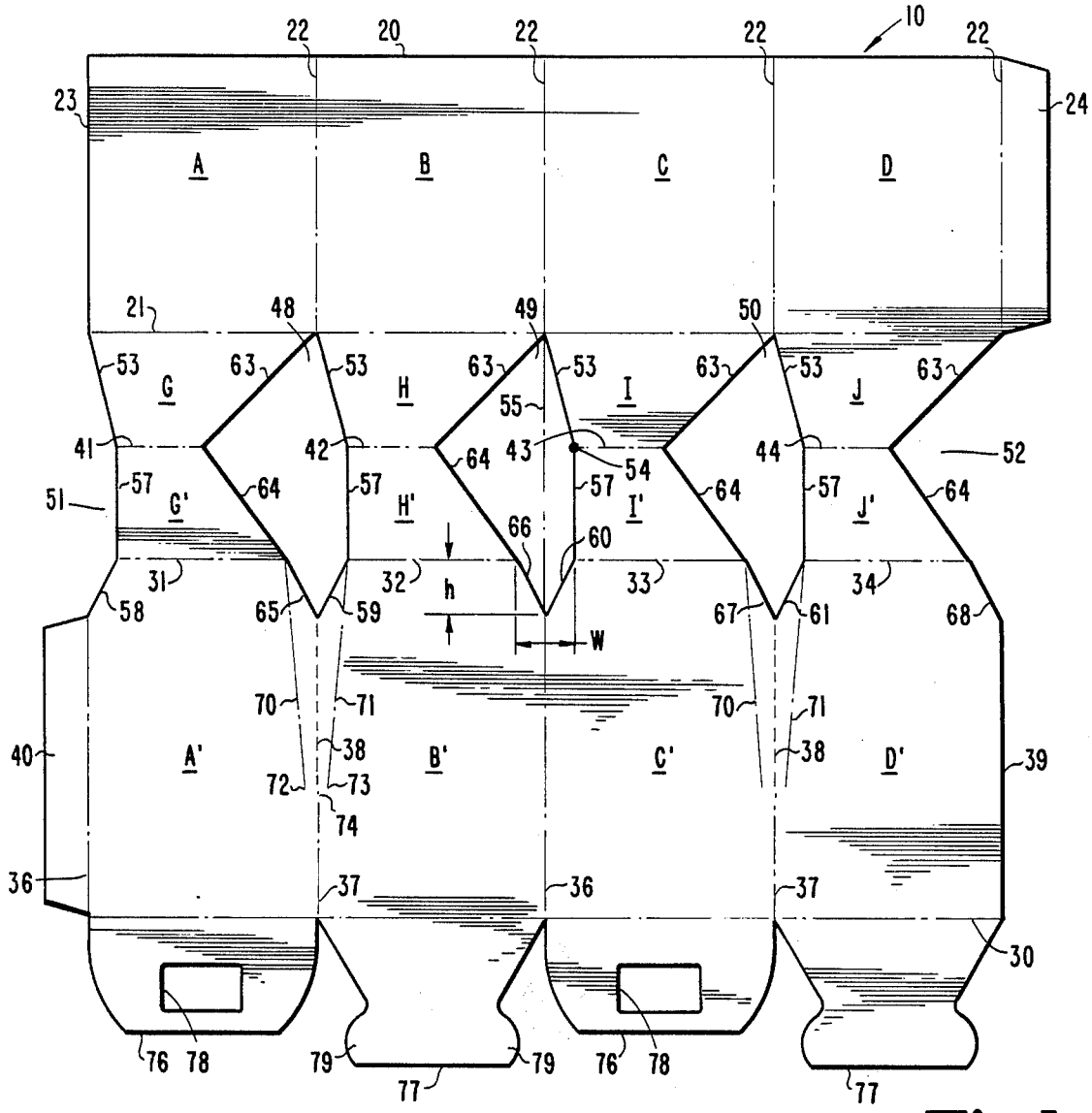
FIG. 1 is a top plan view of a carton blank showing cutouts and score lines in accordance with the preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, there is shown a single blank 10 having various cuts and scores to form a carton in accordance with the preferred embodiment of the present invention. Parallel to edge 20 is a transverse score line 21, both of which, along with longitudinal score lines 22 and edge 23, define identical rectangular panels A, B, C and D. When blank 10 is folded, as described below, glue flap 24, integrally joined with and at the outermost edge of panel D and delimited therefrom by a longitudinal score line 22, will be secured with an appropriate adhesive to the outermost edge of panel A near edge 23. Score lines 22 will hingedly interconnect panels A, B, C and D which will form the four sides of a tubular closure member or shell.

parallel to edge 20 are bottom transverse score line 30 and intermediate transverse score lines 31, 32, 33 and 34. Orthogonal to bottom score line 30 are longitudinal score lines 36 and 37, perforated score lines 38 and edge 39, all of which, along with score lines 30 and 31–34, form identically shaped rectangular panels A', B', C' and D'. Longitudinal score lines 36 and 37, perforated score lines 38 and edge 39 are all colinear with one of score lines 22 making panel A', B', C' and D' vertically correspond with panel A, B, C and D, respectively. When blank 10 is folded, as described below, glue flap 40, integrally joined with and at the outermost edge of panel A' and delimited therefrom by longitudinal score line 36, will be secured with an appropriate adhesive at the outermost edge of panel D' near edge 39. Score lines 36, 37 and 38 hingedly interconnect panels A', B', C' and D' which will form the four sides of a tubular body portion.

Between score lines 21 and score lines 31–34, blank 10 is cut and scored to form four connecting strips which are subdivided by transverse score lines 41, 42, 43 and 44 into two series of trapezoidal connecting panels G, H, I and J (all identical) and G', H', I' and J' (all identical). Panels G–J and G'–J' cooperate with panels A, B, C and D to form a diaphragm-type closure for the carton formed by panels A', B', C' and D'. The long base of each trapezoidal panel G, H, I and J coincides with the bottom edge of panels A, B, C and D, respectively, these edges being defined by score line 21. The short base of each trapezoidal panel G, H, I and J is defined by score lines 41, 42, 43 and 44, respectively. The long base of each trapezoidal panel G', H', I' and J' coincides with the top edge of panels A', B', C' and D', respectively, these edges being defined by coaxial score lines 31, 32, 33 and 34, respectively. The short base of each trapezoidal panel G', H', I' and J' coincides with the short base of trapezoidal panels G, H, I and J, respectively. Transverse score lines 41, 42, 43 and 44 are one-sixteenth inch closer to transverse score lines 31, 32, 33 and 34 than to score line 21.

The remaining. nonparallel sides of panels G, H, I, J, G', H', I' and J' are defined by three interior, identical hexagonal cutouts indicated at 48, 49 and 50 and by exterior cutouts indicated at 51 and 52. The short side 53 of each trapezoidal panel G, H, I and J forms an acute angle with its respective long base (at 21) such that the point (54, for example) at which short side 53 meets its respective short base (43, for example) is at least away from the colinear extension 55 of the nearest longitudinal score lines 22 and 36 by one-sixteenth the width of the respective long base. Thus, regarding cutout 49, the shortest distance between point 54 and line 55 is at least one-sixteenth the width of panel C.

It should be noted, and apparent from FIG. 1, that the three edges 53, 57 and 58 formed by exterior cutout 51 are identical (relative to panels G and G' to the right-hand three edges 53, 57 and 59 of interior cutout 48 (relative to panels H and H'), as well as to the corresponding edges of cutouts 49 and 50. Likewise, edges 63, 64 and 68 formed by exterior cutout 52 are identical (relative to panels J and J') to the lefthand three edges 63, 64 and 67 of interior cutout 50 (relative to panels I and I'), as well as to the corresponding edges of cutouts 48 and 49. In other words, trapezoidal panels G, H, I and J are identical as are panels G', H', I' and J'.

The top portion of each panel A', B', C' and D' is physically separated from the top portion of its adjacent panel (including panel A' from D' when the two are joined via glue flap 40) by lower, straight edges 58, 65, 59, 66, 60, 67. 61 and 68 of cutouts 51, 48, 49, 50 and 52. Each pair of edges—65 and 59, 66 and 60, 67 and 61 (and 68 and 58 when panels A' and D' are joined-)—forms an identical "V-cut," description of which will hereinafter be directed toward just the V-cut between panels B' and C' and which will be referred to as V-cut 60, 66. V-cut 60, 66 is symmetrical about line 55 and has a width w measured between the intersection of edges 66 and 60 with transverse score lines 32 and 33 respectively. V-cut 60. 66 also has a height h measured as the distance below score lines 32 and 33 by which edges 60 and 66 intersect on line 55. The ratio of h to w is less than 2:1 and, in the present embodiment, is 12:13.

The width of each panel A, B, C, D, A', B', C' and D' (the distance between two adjacent longitudinal score lines or edges) is the same. Also, the heights of panels A, B, C and D (the distance between transverse score line 21 and edge 20) are equivalent, as are the heights of panels A', B', C' and D' (the distance between transverse score lines 30 and 31–34). The distance between score line 21 and score lines 31–34 is everywhere equal and is equal to the width of any panel A–D or A'–D'. The sum of the width of a panel A–D or A'–D' plus the height h of a V-cut is always greater than the height of any panel A, B, C or D. Also, the ratio of the height h of a V-cut to the height of any panel A, B, C or D is between 1:4 and 1:8. Furthermore, the width w of a V-cut is equal to between 18% and 28% of the width of any panel.

Converging cut score lines 70 and 71 are provided on either side of perforated score lines 38. Referring to the score lines on and between panels A' and B' (which are identical to those on and between panels C' and D'), score line 70 begins just below the intersection of edge 65 and score line 31. Score line 71 begins just below the intersection of edge 59 and score line 32. Score lines 70 and 71 extend downward toward score line 30 from score lines 31 and 32 a vertical distance equal to between 0.2 and 0.6 inches less than the height of any one of panels A, B, C or D. Score lines 70 and 71 converge downwardly. Points of lower termination 72 and 73 of score lines 70 and 71, respectively, are equidistant from perforated score line 38 with points 72 and 73 being apart a distance equal to between 4% and 13% of the width of any of panels A', B', C' or D' perforated score line 38 extends downward from the intersection of edges 65 and 59 to a point 74 which is an additional 0.1 to 0.5 inches below points 72 and 73. Score lines 37 extend from point 74 to bottom score line 30. Converging cut score lines 70 and 71, perforated score lines 38 and longitudinal score lines 37 are provided only at or near the boundary of panels A' and B' and at or near the boundary of panels C' and D'. Between panels B' and C' and between panels D' and A' (when glue flap 40 connects panels A' and D'), longitudinal score lines 36 are provided for the hinged relationship thereat.

Blank 10 is also provided with a conventional interlocking bottom closure which includes bottom closure flap pairs 76 and 77 which are delimited from panels A', B', C' and D' by score line 30. Flaps 76 each include a tab receiving slot 78. Flaps 77 each include a pair of outwardly opposing tabs 79 which are flexed to fit into slots 78 to complete closure of the bottom.

Figure 2:
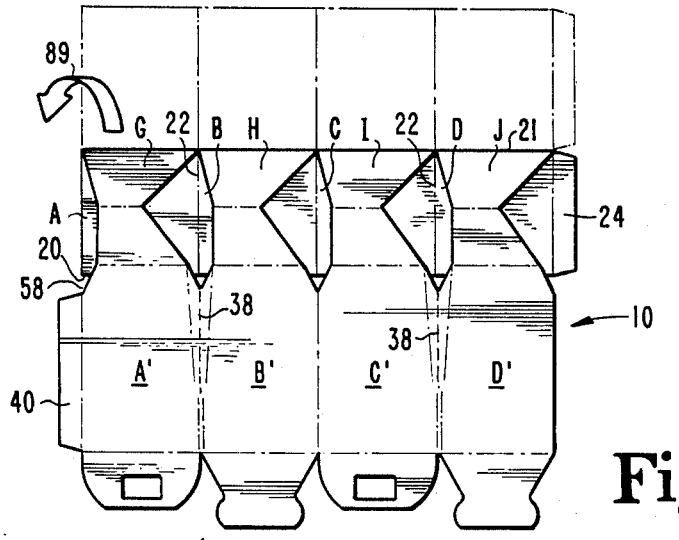
FIG. 2 is a reduced top plan view of the carton blank of FIG. 1 showing the first folding step toward carton construction.
Figure 3:
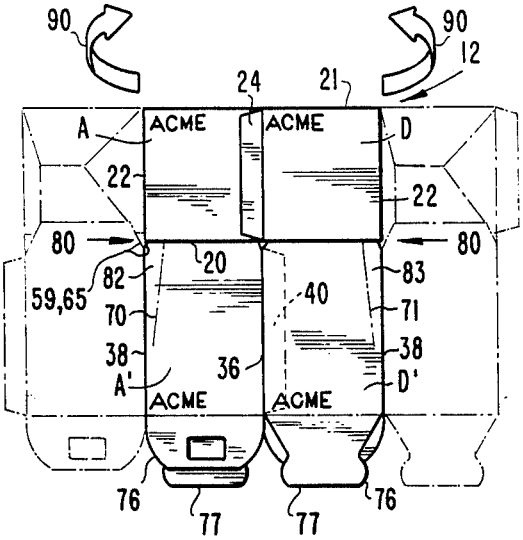
FIG. 3 is a reduced top plan view of the carton blank of FIG. 1 in a completely folded and glued condition.

Conventional paperboard stock is used and, in the preferred embodiment, blank 10 is made from 0.020 SBS C1S folding carton stock. The desired printing is applied to the surface of an uncut and unscored piece of carton stock where panels A–J will be defined. Printing is also applied on the obverse side of the same carton stock where panels A'–D' will be defined. The stock, with printing applied thereon, is then cut and scored to form blank 10 of FIG. 1. Blank 10 is then folded backwards along score line 21 with panels A–D being folded back (arrow 89 of FIG. 2) until they rest flat against the obverse side of the remainder of blank 10. Printing now appears on the surfaces of panels G–J which face upward from the page of FIG. 2 and on the obverse sides of panels A–D and A'–D' as shown in FIG. 2. Score line 21 is now upper edge 21. An appropriate bonding material such as glue is then applied to the surface of glue flap 24 which faces up from the page of FIG. 2 and to the obverse, unshown surface of glue flap 40. Blank 10 is next folded along score lines 22 between panels A and B and between panels C and D and along perforated score lines 38, with panels A. A', G and G' and panels D, D', J and J' arcing in a direction upwards from the page as shown by arrows 90 until panel A' rests flat against panel B' and panel D' rests flat upon panel C', and so panel D' overlaps glue flap 40 and so glue flap 24 overlaps panel A. (FIG. 3) pressure is applied to secure glue flaps 24 and 40 to panels A and D', respectively. The cartons are shipped collapsed as in FIG. 3 to the product manufacturer for packaging of the product within the carton.

At the manufacturer's, collapsed carton 12 is grasped firmly with two hands and lightly squeezed in the direction of arrows 80, carton 12 opening to form a square tube. This step includes one hand holding carton 12 only at the left triangle region 82. Region 82 includes the triangular area principally defined by perforated score line 38 and converging cut score line 70 and the identical triangular area lying directly therebehind which is principally defined by perforated score line 38 and converging cut score line 71 of panel B' (not shown). The one hand holds the triangular region in such a way as to pinch and hold flat together the two above-described triangular areas. The other hand similarly holds and squeezes carton 12 at the other triangular region 83 on the right. When carton 12 is squeezed together in the direction of arrows 80, panels A' and D' will hingedly pivot relative to each other along score line 36 as will panels B' and C' lying therebehind. In the process, panel A' and panel B' (lying therebehind) will be hingedly pivoted relative to one another from an angle of 0° in the collapsed position to 90° in the square tube position. With triangular regions 82 and 83 being held pinched together, panel A' and panel B' (not shown) will bend outwardly from each other and relative to triangular region 82 along converging cut score lines 70 and 71 (not shown), respectively, as will panels D' and C' bend along converging cut score lines 71 and 70 (not shown), respectively. All converging cut score lines 70 and 71 thereby become precreased. Further pinching with the fingers may be desirable to better set the crease in the converging cut score lines 70 and 71. Precreasing of triangular regions 82 and 83 and later absorption of compressive stresses is facilitated by perforated score lines 38. Flaps 76 and 77 of the bottom are then folded in the conventional manner to close the carton's bottom. A tubular paperboard container having four walls, a closed bottom and an upwardly open top defined by edge 21 and panels A–D is now provided (see FIG. 4. A product 84 may now be inserted through top opening 85 defined by edge 21 and into carton 12.

Figure 4:
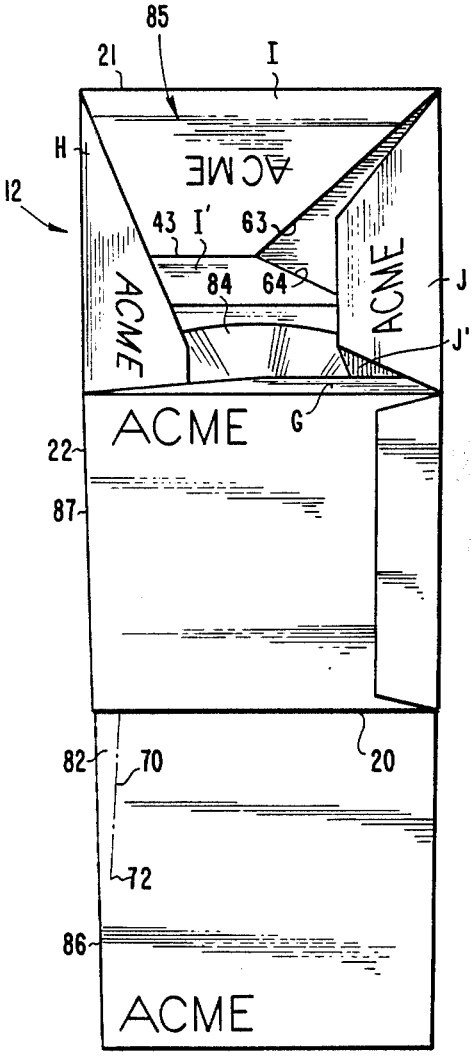
FIG. 4 is an enlarged perspective view of the carton of FIG. 3 in a completely set-up condition and with the closure shell partially closed.

Referring for a moment to FIG. 1, the height h of a V-cut (60, 66, for example) plus the combined height of a pair of connecting panels (H, H', for example) measured from score line 32 to score line 21 is always greater than the height of any upper panel (B). Grasping or setting body portion 86 (panels A', B', C' and D'), on a solid surface, closure shell 87 (panels A, B, C and D) is next grasped and compressed downward relative to body portion 86. Thus, when closure shell 87 (FIG. 4) is initially compressed relative to body portion 86, the bottom edge 20 of closure shell 87 will be above the bottom of each V-cut (see FIGS. 2 and 3). Heretofore, each pair of trapezoidal panels (I and I', for example) between corresponding rectangular panels (C and C') has remained in the same plane as the corresponding lower rectangular panel (C'). Upon compression of closure shell 87 downward against body portion 86, each pair of trapezoidal panels (I and I') buckles inwardly relative to carton 12 along their mutual score line (43). Referring specifically to FIG. 4, as trapezoidal panels I and I' buckle inwardly, their corresponding long sides 63 and 64 form a V-shaped cavity within which folding connecting panels J and J' extend. Likewise, trapezoidal panels G and G' nest within the V-shaped cavity formed by the long sides of panels J and J', panels H and H' nest within the V-shaped cavity formed by the long sides of panels G and G' (see also FIG. 5) and panels I and I' nest within the V-shaped cavity formed by the long sides of panels H and H'.

Figure 5:
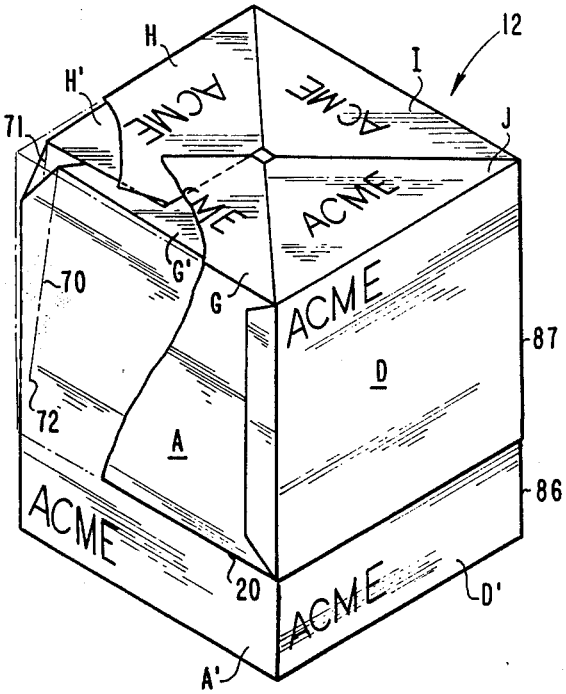
FIG. 5 is a perspective view of the carton of FIG. 4 with the closure shell in a completely closed condition and with portions broken away to show internal carton relationships.

It should be observed that triangular regions 82 and 83 are now at two opposing corners of the fully constructed carton 12 shown in FIGS. 4 and 5, with only region 82 visible in either figure.

The cross-sections of body portion 86 and of closure shell 87 are identical in so far as the width of their corresponding panels A, B, C and D and A', B', C' and D' are identical. However, precreased triangular regions 82 and 83 allow a predetermined amount of buckling of panels A', B', C' and D' of body portion 86, allowing closure shell 87 to telescope downward around body portion 86. Telescopic movement of closure shell 87 relative to body portion 86 is relatively easy until bottom edge 20 nears points of lower termination 72 and 73 of converging cut score lines 70 and 71, respectively. (FIGS. 4 and 5) Closure shell 87 is compressed downward the final half-inch or so. Unaided by score lines in this final half-inch region, panels A', B', C' and D' continue to buckle slightly along the projection of converging cut score lines 70 and 71 and against the structural resistance of the paperboard. This resistance to defamation and reduction in external perimeter is exhibited as friction between body portion 86 and closure shell 87 resulting in a frictional locking therebetween. Closure shell 87 is thereby frictionally held in a closed position until a sufficient tensile force between closure shell 87 and body portion 86 is applied to open carton 12. The properties of the paperboard used in the present embodiment exhibit sufficient elastic properties to produce an effective holding force to keep closure shell 87 in a closed position and to resist tearing at the lower portion of score lines or seams 22.

The carton 12 shown in FIG. 5 is in the closed, friction locked condition as it would appear sitting on the vendor's shelf. All the marketing and product information is printed on the exposed panels A, B, C, D, G, H, I, J and the bottom portion of panels A', B', C' and D'. When carton 12 is opened, by pulling closure member 86 upward relative to body portion 86, the remainder of panels A', B', C' and D' and possibly some of trapezoidal panels G', H', I' and J' depending on the height of panels A, B. C and D) are revealed—an area potentially equal to the square of the width of the container.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A single blank having a top and a bottom and for forming a one-piece paperboard container with telescopically openable and closable closure member, comprising:

a first set of four serially connected, identically shaped, substantially rectangular panels defined at the bottom of the blank, each panel having a top and a bottom, said first set having opposing ends hingedly joinable to form a tubular body portion;

a second set of four serially connected, identically shaped, rectangular panels defined at the top of the blank, each panel of said second set having a bottom and a height, said second set having opposing ends hingedly joinable to form a portion of a tubular closure member, each panel of said second set vertically corresponding to and aligned with a panel of said first set;

a third set of four connecting strips connecting vertically corresponding panels of said first and second sets, adapted to cooperatively form a closure member, and to cooperate with said first and second sets to provide telescopic movement of the closure member relative to the body portion, said strips adapted to fold within one another to form a top for the closure member;

a series of V-cuts between adjacent panels of the first set of panels and at the tops thereof; and two pairs of converging cut score lines, one score line of each pair beginning just outside of one side of a corresponding V-cut and the other score line of each pair beginning just outside of the opposite side of the corresponding V-cut, both score lines of each pair beginning just below said third set and extending convergingly downward a distance less than the height of said second set.

2. The single blank of claim 1 wherein each pair of converging cut score lines has a height between 0.2 and 0.6 inches less than that of said second set, and wherein the blank further includes bottom means for providing a bottom to the container.

3. The single blank of claim 2 wherein said two pair of converging cut score lines are adapted to be on opposite corners of the tubular body portion.

4. The single blank of claim 3 further including a perforated score line situated equally between each pair of converging cut score lines, beginning just below the corresponding V-cut and extending between 0.1 to 0.5 inches below the converging cut score lines.

5. The single blank of claim 1 wherein each V-cut is identical and has a height and a width, the height to width ratio being less than 2:1.

6. A flat blank for forming a one-piece carton and telescopic closure member, comprising:

a first generally rectangular section subdivided by first longitudinal parallel score lines into a first set of four substantially rectangular panels and a first glue flap, each panel having an identical shape and a top and a bottom, the first glue flap being adjacent to only one of the panels at one side of said first section ad sized to be adhesively bonded to the panel situated at a side of said first section opposite from the one side;

a second central section including four identical, separate and serially adjacent connecting panels, each connecting panel delimited from the top of a corresponding one of the four rectangular panels by one of a set of first colinear transverse score lines, each connecting panel subdivided into first and second trapezoidal panels by one of a set of second colinear transverse score lines, each of which is parallel to the first transverse score lines and defines a common short base for its adjacent first and second trapezoidal panels, each trapezoidal panel having a long base, a long side and a short side, and wherein each of the first transverse score lines defines the long base of each first trapezoidal panel;

a third upper generally rectangular section delimited from said second section by a third transverse score line which is parallel to the first transverse score lines and which defines the long base of each second trapezoidal panel, said third section being subdivided by second longitudinal parallel score lines into a second set of four equal rectangular panels and a second glue flap, each panel of the second set of panels having a top edge and having a bottom edge coexisting as the long base of each second trapezoidal panel, the second glue flap being adjacent to only one of the panels of the second set of panels at on side of said third section and being sized to be adhesively bonded to the panel situated at a side of said third section opposite from the one side of said third section;

bottom flap means, delimited from the bottom of the first panels of said first section by a fourth transverse score line, and for providing a bottom to the one-piece carton when the blank is transferred into the carton;

wherein adjacent nonparallel sides of any two adjacent connecting panels are defined by a hexagonal cutout, a first two adjacent edges of the cutout defining the long sides of the first and second trapezoidal panels of one of the two adjacent connecting panels, a second two adjacent edges of the cutout defining the short sides of the first and second trapezoidal panels of the other of the two adjacent connecting panels, and a third two adjacent edges of the cutout defining a V-cut, wherein the V-cut extends from the first transverse score lines and converges downward between the two of said first set of four panels which are adjacent to the any two adjacent connecting panels, wherein the third two adjacent edges are symmetrical about and converge to a point on the longitudinal score line which subdivides the two of said first set of four panels, and wherein the V-cut has a width and a height; and wherein the first longitudinal score lines which divide the first set of four rectangular panels include first, second and third longitudinal score lines, the first score line dividing a side panel and an intermediate panel, the second score line dividing the intermediate panel and another intermediate panel and the third score line dividing the another intermediate panel and another side panel, wherein the side panel and the intermediate panel each include one of a first pair of converging cut score lines which begin just below the first transverse score lines near the V-cut which is adjacent both the side panel and the intermediate panel, the converging cut score lines convergingly extending downward a distance less than the distance between the top edge of the second set of panels and the third transverse score line, and wherein the another intermediate panel and the another side panel include a second pair of converging cut score lines identically sized and situated as the first pair of converging cut score lines of the side and intermediate panels.

7. The flat blank of claim 6 wherein the ratio of the height to the width of the V-cut is less than 2:1.

8. The flat blank of claim 7 wherein the first and third longitudinal score lines are perforated score lines from the first transverse core lines down to a point between 0.2 and 0.5 inches below the converging cut score lines.

9. The flat blank of claim 8 wherein the ratio of the height of the V-cut to the distance between the third transverse score line and the top edges of the second set of panels is between 1:4 and 1:8 and wherein both pair of converging cut score lines convergingly extend downward a distance equal to between 0.2 and 0.6 inches less than the distance between the top edges of the second set of panels and the third transverse score line.

10. The flat blank of claim 7 wherein the sum of the distance between any two adjacent second longitudinal parallel score lines and the height of the V-cut is greater than the distance between the top edge of the third section and third transverse score line.

11. The flat blank of claim 10 wherein the width of the V-cut is equal to between 18% and 28% of the distance between any two adjacent first longitudinal parallel score lines.

12. The flat blank of claim 11 wherein the bottom flap means includes a first pair of flaps having slots and a second pair of flaps having tabs insertable within the slots, each of the first pair of flaps being attached to one of two nonadjacent panels of the first section.

13. The flat blank of claim 10 wherein the pair of converging cut score lines converge together to a distance between 4% and 13% of the distance between any two adjacent first longitudinal score lines.

14. The flat blank of claim 7 wherein the first glue flap and the second glue flap are situated on opposite sides of the blank.

15. A method for providing a paperboard carton having additional exterior advertising space revealable upon opening the carton, comprising the steps of:

providing a single flat blank having a front and a back and defining a first set of four serially adjacent and substantially identical rectangular panels, the panels having colinear tops with corners, having bottoms and sides and being hingedly interconnected, a first of the rectangular panels being on one side of the blank, a fourth of the rectangular panels being on a side of the blank opposite the one side, a second and third of the rectangular panels being mutually adjacent and being between the first and fourth panels, the first and fourth panels each having a mutually outermost edge, said blank further defining a second set of four, serially adjacent, substantially identical rectangular panels having colinear tops, bottoms and sides and being hingedly interconnected, each of the second set of four panels vertically corresponding with one of the first, second, third and fourth panels, the panels of the second set of four panels which vertically correspond to the first and fourth panels also each having a mutually outermost edge, said blank further defining four equally shaped connecting strips having edges, each strip hingedly connecting the top of one of the panels of the first set of panels to the bottom of a vertically corresponding panel of the second set of panels, each connecting strip being hingedly subdivided by a score line situated midway between the top of the first set of panels and the bottom of the second set of panels, each score line forming in its connecting strip a pair of trapezoidal panels sharing a common short base, the edges of any two adjacent connecting strips defining a polygonal cutout;

cutting away an equal portion of all the corners of each panel of the first set of panels forming between any two adjacent panels of the first set of panels a V-cut which is in communication with the polygonal cutout, the V-cut having a height and a width;

longitudinally scoring the blank between each pair of adjacent, rectangular panels;

transversely scoring the blank between each rectangular panel and adjacent connecting strip;

convergingly scoring the first and second panels from points just below the intersection of the tops of the first and second panels and the V-cut mutually adjacent to the first and second panels, the converging scoring being symmetrical about the longitudinal scoring between the first and second panel, and extending downward a distance less than the distance between the top and bottom of one of the second set of panels;

convergingly scoring the third and fourth panels in a manner identical to the convergingly scoring the first and second panels step;

providing bottom closure means, connected to the bottom of at least one of the first set of panels, for providing a bottom to the carton;

folding the second set of panels at the longitudinal scoring between the second set of panels and the connecting strips, the second set of panels being folded 180° to a position flat against the back of the remainder of blank;

folding the first panel, the corresponding panel of the second set of panels and the corresponding connecting strip 180° along the adjacent longitudinal score lines and toward the front of the blank to a position where the first panel lays flat against the second panel;

folding the fourth panel, the corresponding panel of the second set of panels and the corresponding connecting strip 180° along the adjacent longitudinal score lines and toward the front of the blank to a position where the fourth panel lays flat against the third panel and each of the second set of panels lays flat against the outside of the connecting panels;

hingedly securing together the outmost edges of the first and fourth panels; and hingedly securing together the outmost edges of the panels of the second set of panels.

16. The method for providing a paperboard carton of claim 15 wherein the cutting step includes cutting the corners so that the height of the V-cut is less than twice its width.

17. The method for providing a paperboard carton of claim 16 wherein the converging scoring of the first, second, third and fourth panels extends downward a distance between 0.2 and 0.6 inches less than the distance between the top and bottom of one of the second set of panels.

18. The method for providing a paperboard carton of claim 17 wherein the longitudinally scoring step includes providing perforated scoring between the converging scoring of the first and second panels and between the converging scoring of the third and fourth panels, the perforated scoring extending between 0.1 and 0.5 inches below the converging scoring.

19. The method for providing a paperboard carton of claim 18 wherein the cutting step includes, cutting the corners so that the height of the V-cut is between one-fourth and one-eighth the distance between the top and bottom of any panel of the second set of panels.

* * * * *

UNITED STATES PATENT AND TRADEMARK OFFICE

CERTIFICATE OF CORRECTION

PATENT NO. : 4,795,081

DATED : January 3, 1989

INVENTOR(S) : Richard N. Miller

It is certified that error appears in the above-identified patent and that said Letters Patent is hereby corrected as shown below:

In column 2, line 56, please change "parallel" to --Parallel--.

In column 3, line 28, please change the period to a comma.

In column 3, line 43, please insert --)-- after "G'".

In column 3, line 57, please change "67." to --67,--.

In column 3, line 67, please change "60." to --60,--.

In column 4, line 34, please change "D' perforated" to --D'. Perforated--.

In column 5, line 11, please change "pressure" to --Pressure--.

In column 5, line 54, please insert --)-- after "FIG. 4".

In column 6, line 56, please insert --(-- after "D'".

In column 6, line 58, please change "B." to --B,--.

In column 7, line 60, please change "ad" to --and--.

In column 8, line 21, please change "on" to --one--.

In column 8, line 28, please change "transferred" to --transformed--.

In column 9, line 7, please change "core" to --score--.

In column 11, line 5, please delete the comma.

Signed and Sealed this

Twenty-fifth Day of April, 1989

*Attest:*

*Attesting Officer*

DONALD J. QUIGG

*Commissioner of Patents and Trademarks*